United States Patent [19]

Lamb

[11] Patent Number: 4,820,374

[45] Date of Patent: Apr. 11, 1989

[54] ROLL HEADER PLATEN

[75] Inventor: Vernon L. Lamb, Sparta, Mich.

[73] Assignee: Fortifiber Corporation, Los Angeles, Calif.

[21] Appl. No.: 642,569

[22] Filed: Aug. 20, 1984

[51] Int. Cl.[4] ..... B32B 31/00

[52] U.S. Cl. ..... 156/538; 53/137; 156/583.4

[58] Field of Search ..... 156/583.4, 292, 538, 156/308.4; 206/413, 414, 416; 53/116, 129, 137, 142, 397, 580; 100/938; 219/243, 245, 246, 247, 254, 255, 445, 446, 464, 480, 486

[56] References Cited

U.S. PATENT DOCUMENTS

| | | | |
|---|---|---|---|
| 1,840,222 | 1/1932 | Brown | 53/137 |
| 2,448,478 | 8/1948 | White | 53/137 X |
| 2,640,906 | 6/1953 | Haynes | 219/464 X |
| 2,649,876 | 8/1953 | Thompson et al. | 156/583.4 X |
| 2,803,935 | 8/1957 | Gibson | 53/137 |
| 2,883,045 | 4/1959 | Abramson | 206/396 X |
| 3,315,432 | 4/1967 | Turnbull et al. | 53/3 |
| 3,386,503 | 6/1968 | Corning et al. | 156/583.4 X |
| 3,408,247 | 10/1968 | Derr, Jr. | 156/538 |
| 3,416,491 | 12/1968 | Turnbull et al. | 118/411 |
| 3,429,097 | 2/1969 | Jasper et al. | 53/66 |
| 4,148,395 | 4/1979 | Syracuse et al. | 206/414 |
| 4,303,462 | 12/1981 | Karr | 156/538 |
| 4,352,707 | 10/1982 | Wengler et al. | 156/94 X |
| 4,493,979 | 1/1985 | Bredel et al. | 219/446 |

*Primary Examiner*—Michael W. Ball
*Assistant Examiner*—Ramon R. Hoch
*Attorney, Agent, or Firm*—Price, Heneveld, Cooper, DeWitt & Litton

[57] ABSTRACT

The specification discloses an improved platen for a paper roll header. The platen has a two-piece face including an inner circular portion and an outer portion eccentrically surrounding the inner portion. The two face portions are independently heatable enabling the outer portion alone to be heated in certain applications to adhere a head to the periphery of a particular size roll.

8 Claims, 2 Drawing Sheets

ROLL HEADER PLATEN

BACKGROUND OF THE INVENTION

The present invention relates to roll headers, and more particularly to roll header platens.

In the paper manufacturing industry, paper is prepared in long ribbons which are wound or spooled to form cylindrical rolls. Typically, the rolls of paper are wrapped with a protective wrapping, or roll wrapper, in the form of a strip of paper wrapped about the cylindrical surface of the roll and protruding at least several inches beyond each end of the roll. The protruding ends of the wrapper are flattened against the ends of the roll by forming crimps or folds about the peripheral edges of the wrapper. Heavy paper discs or "heads" are usually adhered to the ends of the wrapped rolls to seal the ends thereof.

Often, a two-piece head is used at each end of the roll. An inner head is inserted within the crimped end of the roll wrapper, and an outer head overlies the crimped wrapper edge. The outer head includes a heat activatable adhesive, such as polypropylene, on its inside surface. A heated platen then engages the outer head to force the head against the roll and to tackify the adhesive, sealing the head to the roll. The polypropylene on the inside surface of the outer head acts both as an adhesive and as a vapor barrier. However, this method of heading a paper roll is relatively expensive inasmuch as two heads are required at each end of the roll (i.e., one inside the crimped wrapper and one outside the crimped wrapper). If the inside head is omitted, the outside head adheres to the rolled paper exposed at the roll end inwardly of the crimped roll wrapper.

SUMMARY OF THE INVENTION

The aforementioned problems are overcome in the present invention wherein an improved roll header platen is provided enabling a roll to be heated using a one-piece head. More particularly, the platen includes an inner heatable face and an outer heatable face surrounding and coplanar with the inner heatable face. The inner and outer platen faces are independently heatable. In a preferred embodiment of the invention, both the inner and outer faces have generally circular peripheries, and the inner face is eccentrically positioned within the outer face toward the lower portion thereof.

Each end of a relatively large roll of paper supported on the roll header is abutted about its periphery only by the outer platen face. With such a roll, the outer face is run "hot" and the inner face is run "cold" enabling a single head to be used to seal each end of the wrapped roll. The outer face activates the adhesive on the head only in the region of the crimped roll wrapper. The cold inner face does not activate the head adhesive in the central area of th head, so the head is not adhered to the roller paper.

Each end of a relatively small roll of paper supported on the roll header is abutted about its periphery by both the inner and outer platen faces, which are then run "hot" to adhere outer heads to the roll ends in a conventional manner also using inner heads. The platen of the present invention therefore accommodates a multitude of different size rolls in the roll heater. Additionally, when the rolls are of a size engaged about their peripheries only by the outer platen face, the inner face can be run "cold" to save energy and to prevent the single outer head from adhering to the rolled paper.

These and other objects, advantages, and features of the invention will be more fully understood and appreciated by reference to the detailed description of the preferred embodiment and the drawings. cl BRIEF DESCRIPTION OF THE DRAWINGS FIG. 1 is a perspective, schematic view of a roll header including the platen of the present invention;

DETAILED DESCRIPTION OF THE PREFERRED EMBODIMENT

Figure 1:
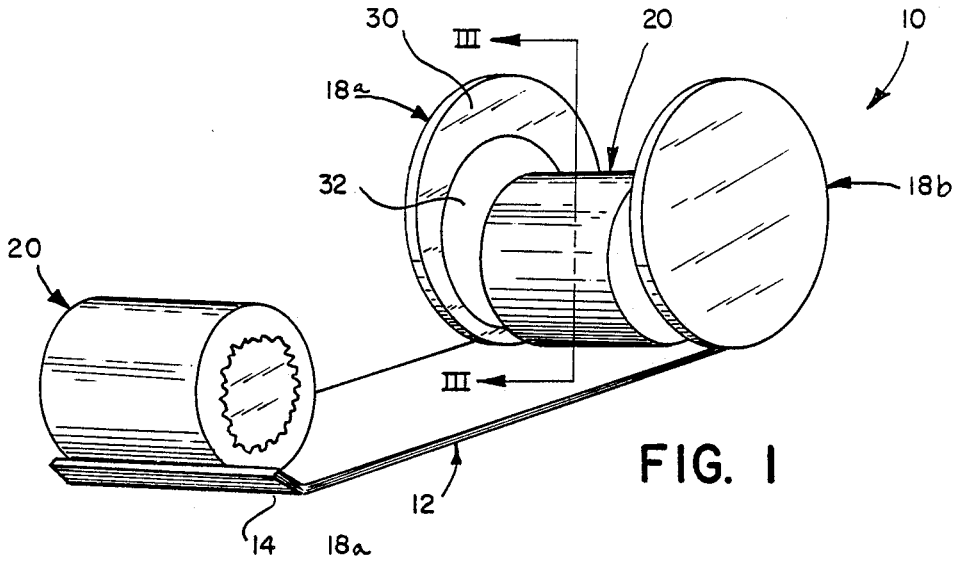
Figure 2:
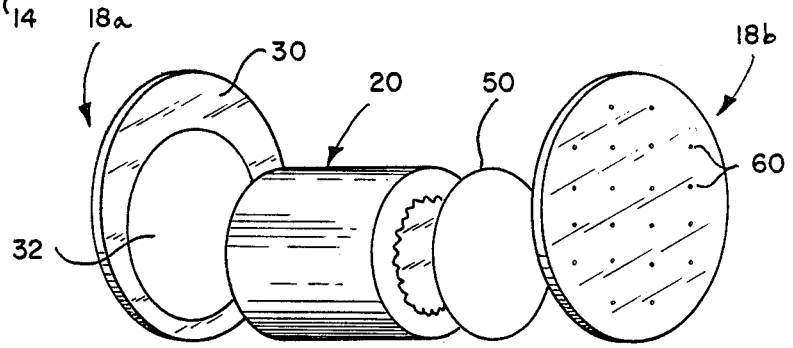
FIG. 2 is a perspective view of the platens and a paper roll and head positioned therebetween.

A roll header including the platen of the present invention is illustrated in FIG. 1 and generally designated 10. The roll header includes paper roll support means or platform 12 including receiving ramp 14 and a pair of rollers 16*a* and 16*b* (see also FIGS. 3 and 4). The rollers are positioned between a pair of platens 18*a* and 18*b*. Roll header 10 receives wrapped paper roll 20 from a conventional roll wrapper (not shown) on receiving ramp 14, and the roll 20 continues under its momentum to stop on rollers 16 between platens 18. Heads are applied to roll 20 as will be described, and the roll is then ejected from the roll header by a conventional device.

Each of platens 18 (FIGS. 3–4 and 6–7) includes outer unit or portion 30 and inner unit or portion 32. Outer unit 30 (FIG. 7) has a generally circular periphery 34 and a generally circular aperture or opening 36 eccentrically positioned within the outer unit toward the lower portion thereof. Inner platen 32 also includes a generally circular periphery 38 which is generally the same in diameter as aperture 36 enabling the inner platen to be closely received within outer platen 30. In the assembled platen, inner unit 32 is eccentrically positioned within outer unit 30 toward a lower portion thereof. Both of platen portions 30 and 32 are secured to a conventional platen support frame (not shown) using conventional techniques so as to be reciprocable toward and away from one another to engage a paper roll therebetween.

Figure 5:
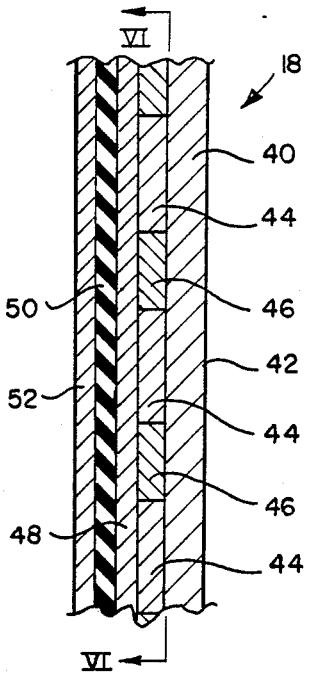
FIG. 5 is a sectional view through the platen.

Each of platens 18, including each of inner and outer units 30 and 32, has a sandwiched construction (FIG. 5). Each platen includes face plate 40 having exposed face 42. A plurality of heater elements 44 abut, or are adjacent to, face plate 40 to apply heat thereto. The heater elements are separated by aluminum spacer bars 46. Intermediate plate 48 is secured to face plate 40 using conventional techniques to sandwich heater elements 44 and spacer bars 46 therebetween. A ceramic fiber mat 50 overlays intermediate plate 48; and back plate 52 is secured to intermediate plate 48 using conventional techniques to secure the insulation layer therebetween. In the preferred embodiment, face plate 40, intermediate plate 48, and back plate 52 are all fabricated of aluminum having thicknesses of one-half inch, one-quarter inch, and one-quarter inch, respectively. Heater elements 44 are preferably CHROMOLUX strip heaters being three-eighths inch thick and one and one-half inches wide. Spacer bars 46 are also fabricated of aluminum and are three-eighths inch thick and one inch wide. The sandwiched platen elements are preferably intersecured by bolts extending through the elements from back plate 52 to face plate 40.

Figure 6:
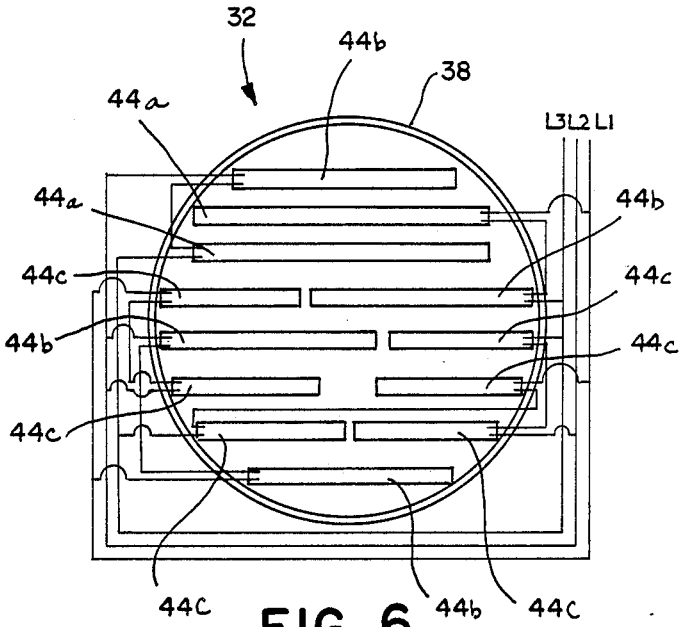
FIG. 6 is a sectional view taken along plane VI—VI with the spacer bars removed showing the wiring diagram for the heater elements in the inner platen face.

FIG. 6 shows the wiring diagram for the heater elements within inner unit 32. The CHROMOLUX heater elements 44 have the following lengths:

| Designating Numeral | Length |
|---|---|
| 44a | 24 inches |
| 44b | 18 inches |
| 44c | 12 inches |

The various heater elements 44 are connected to three-phase power lines L1, L2, and L3 as indicated to power the heater elements.

Figure 7:
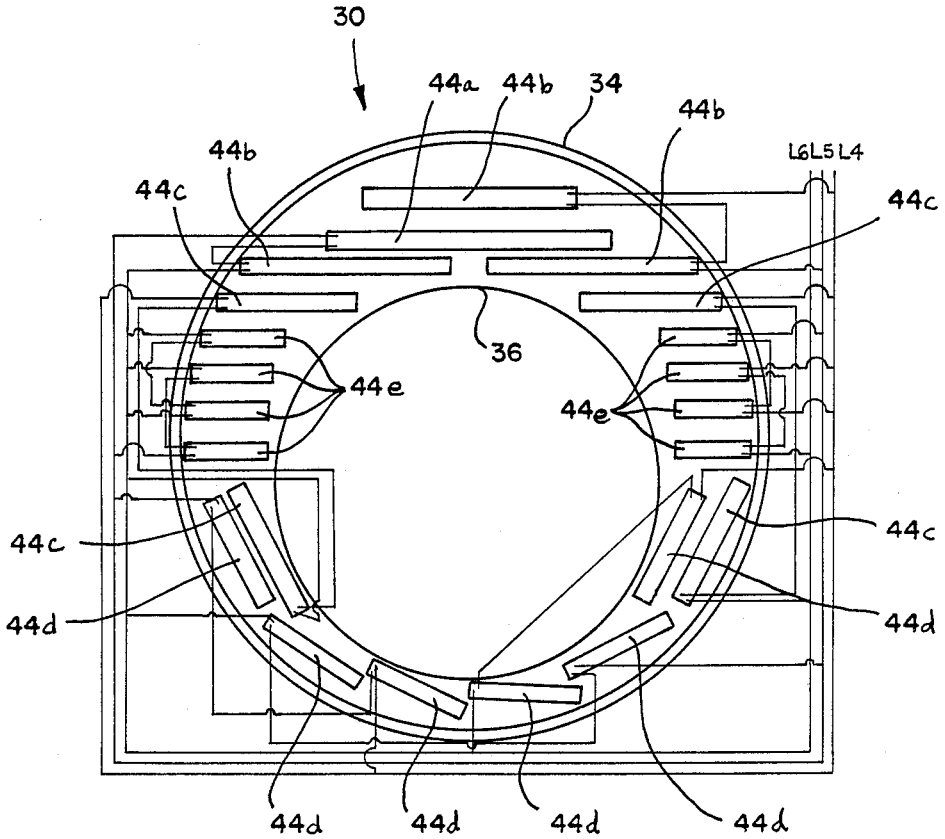
FIG. 7 is a sectional view taken along plane VI—VI with the spacer bars removed showing the wiring diagram for the heater elements in the outer platen face.

FIG. 7 illustrates the wiring diagram for the heater elements within outer unit 30. The CHROMOLUX heater elements 44 have the following lengths:

| Designating Numeral | Length |
|---|---|
| 44a | 24 inches |
| 44b | 18 inches |
| 44c | 12 inches |
| 44d | 10 inches |
| 44e | 7 inches |

The heater elements 44 within outer unit 30 are coupled to three phase power lines L4, L5 and L6 as indicated to heat the outer platen face.

In both units 30 and 32, heater elements 44 are arranged to provide approximately six to seven watts per square inch of face area. This wattage is particularly suitable for use with the polypropylene coated heads currently commercially available. Heater elements 44 are preferably arranged to provide a slightly higher power output at the bottom of the platens because of the fact that heat rises therein.

OPERATION

The operation of roll header 10 is illustrated in FIGS. 1–4. The roll header applies heads 50 (FIG. 2) to the opposite ends of wrapped paper roll 20. In the preferred embodiment, heads 50 are fabricated of kraft paper and are coated on one side with polypropylene which acts both as a vapor barrier and as a temperature-sensitive adhesive. The heads are generally circular and have a diameter only slightly less than the diameter of wrapped roll 20 so that the heads cover substantially the entire end of the wrapped roll.

Figure 3:
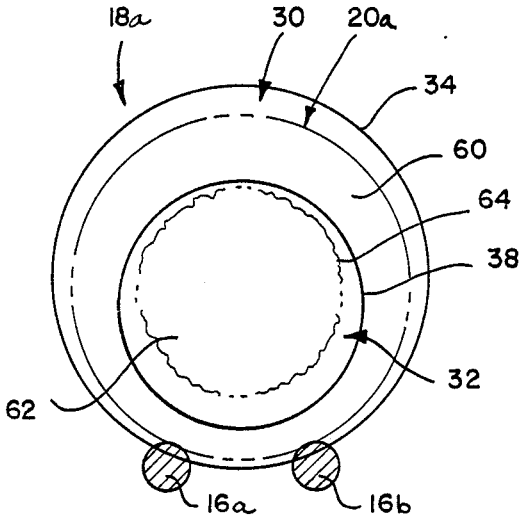
FIG. 3 is a view taken along plane III—III in FIG. 1 with a large size paper roll shown in phantom.
Figure 4:
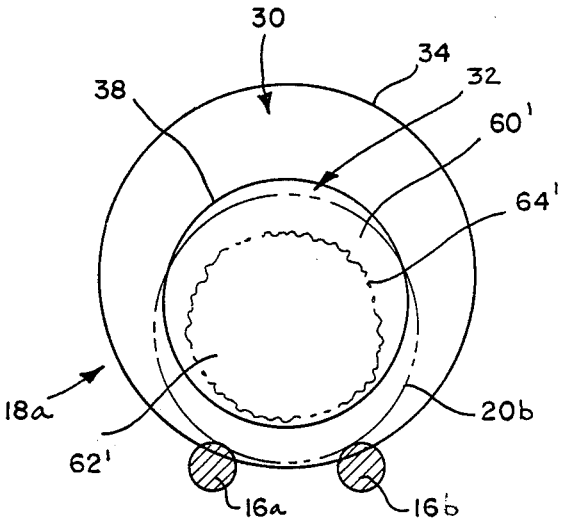
FIG. 4 is a view taken along plane III—III in FIG. 1 with a small size paper roll shown in phantom.

The wrapped rolls 20 are received from a conventional roll wrapper, and travel down ramp 14 and across support table 12 to stop on rollers 16 (see also FIGS. 3 and 4). Heads 50 are placed against platens 18 and are held thereagainst by vacuum force as is conventional in the industry, for example as drawn through holes 60 (FIG. 2) in platens 18. The vacuum holes are not illustrated in the other figures. The platens are then actuated to force the heads 50 into engagement with the ends of the wrapped roll 20. Additionally, the platens are heated such that the polypropylene is tackified to adhere the head to the wrapped roll.

During operation, either (1) the outer unit 30 alone or (2) the outer and inner units 30 and 32 together are heated depending on the size rolls to be headed. A large size roll 20a is illustrated in phantom in FIG. 3 superimposed on platen **18*a*. The wrapped roll includes crimped wrapper portion 60 and exposed rolled paper portion 62. The diameter of roll 20*a* is such that when the roll is supported on rollers 16, the roll extends upwardly beyond inner unit 32. However, the inner diameter 64 of crimped wrapper portion 60 lies entirely within the confine of inner unit 32. Consequently, the crimped portion 60 of the wrapper is abutted about its entire periphery by outer unit 30 when platen 18 is forced against the roll. When wrapping a roll of this size, only outer platen 30 is heated so that the adhesive is activated only in the area of crimped portion 60. Consequently, the head 50 is adhered only to the crimped portion and does not adhere to the exposed paper in area 62**. An inner head piece is therefore unnecessary.

FIG. 4 illustrates a small wrapped roll **20*b* on rollers 16. The diameter of roll 20*b* is such that when supported on rollers 16, the roll does not extend upwardly beyond inner unit 32. When wrapping a roll of this size, both inner and outer units 30 and 32 are heated so that the entire head 50 is heated and adhered to the wrapped roll. When wrapping a roll of this size, an inner head must also be used within crimped portion 60' to prevent the activated adhesive from adhering to the exposed rolled paper 62'**.

Roll header 10 is typically designed to wrap primarily one size roll. The diameters and relationship of outer and inner units 30 and 32 are selected to preferably provide the relationship illustrated in FIG. 3 with respect to the primary size of roll to be headed. This design enables the use of a single header at either end of the roll and further enables the inner unit 32 to be run "cold" during heading. When smaller rolls are to be headed as illustrated in FIG. 4, both platen portions can be heated to apply heads to the wrapped rolls in a conventional manner using inner and outer heads. The present invention therefore provides the versatility to wrap virtually any size roll, while providing both material and energy savings with the most commonly sized roll.

The above description is that of a preferred embodiment of the invention. Various changes and alterations can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A roll header comprising:

roll means for supporting a roll of paper; and first and second platens on opposite sides of said roll means for selectively engaging the opposite ends of a roll of paper supported on said roll means, each of said platens including a generally circular outer heatable face and a generally circular inner face positioned therein, said outer face being heatable independently of said inner face, said inner and outer faces being generally coplanar and facing the other platen, said outer face surrounding said inner face, said inner face being eccentric within said outer face toward said roll means, said inner face being located above said roll means, whereby the entire perimeter of the end of a roll of paper supported on said roll means and extending upwardly beyond said inner face can be heated by said outer face alone and further whereby the area on the end of the roll of paper covered by said inner face can remain unheated.

2. An improved roll header including a paper roll support means and a pair of heated platens on either side thereof, wherein the improvement comprises said heated platens, each of which comprises:

a generally circular inner platen portion including a selectively heatable generally planar surface facing said support means; and a generally circular outer platen portion surrounding said inner platen portion, said outer platen portion having a lower portion, said inner platen portion being eccentrically located within said outer platen portion toward said lower portion, said outer platen portion including a selectively heatable generally planar surface generally coplanar with said inner platen portion surface, said inner and outer platen surfaces being heatable independently of one another, whereby the perimeter of the end of a roll of paper having a diameter greater than the diameter of said inner platen portion on said support means can be heated by said outer platen portion alone enabling said inner platen portion to remain unheated, and further whereby the entire end of any roll of paper on said support means can be heated by said inner and outer platens together.

3. An improved roll header as defined in claim 1 wherein each of said platen portions includes a face plate having said heatable surface and a plurality of heating elements abutting said face plate opposite said heating surface.

4. An improved roll header as defined in claim 3 wherein each of said platen portions further includes:

an intermediate plate abutting said heating elements opposite said face plate;

an insulating layer abutting said intermediate plate opposite said heating elements; and a back plate abutting said insulating layer opposite said intermediate plate.

5. A heatable roll member platen comprising:

a generally planar generally circular inner face including means for heating said inner face; and a generally planar generally circular outer face including means for heating said outer face, said inner face being generally coplanar with and surrounded by said outer face, said inner and outer faces being eccentric with respect to one another, said heating means being independently actuable to permit one of said faces to be heated while the other of said faces is not;

both of said inner and outer faces defining vacuum holes extending therethrough, enabling a partial vacuum to be drawn against said faces to draw a roll head against said faces.

6. A heatable platen as defined in claim 5 further comprising:

inner and outer face plates defining said inner and outer faces, respectively;

a plurality of heating elements adjacent each of said face plates;

a plurality of spacer members adjacent each of said face plates between selected ones of said heating elements; and inner and outer intermediate plates secured to said inner and outer face plates, respectively, to sandwich said heating elements and spacer bars therebetween.

7. A heatable platen as defined in claim 6 further comprising:

inner and outer insulation pieces overlying said first and second intermediate plates, respectively; and inner and outer back plates secured to said first and second intermediate plates, respectively, to sandwich said insulation pieces therebetween.

8. A roll header comprising:

roll means for supporting a roll of paper; and first and second platens on opposite sides of said roll means for selectively engaging the opposite ends of a roll of paper supported on said roll means, each of said platens including a generally circular outer heatable face and a generally circular inner face heatable independently of said outer face and positioned therein, said inner and outer faces being generally coplanar and facing the other platen, said outer face surrounding said inner face, said inner face being eccentric within said outer face toward said roll means, said inner face being located above said roll means, whereby the entire perimeter of the end of a roll of paper supported on said roll means and extending upwardly beyond said inner face can be heated by said outer face alone and further whereby the area on the end of the roll of paper covered by said inner face can remain unheated, and further whereby said platens can be operated either with only said outer faces heated or with both said inner and outer faces heated.

* * * * *

UNITED STATES PATENT AND TRADEMARK OFFICE

CERTIFICATE OF CORRECTION

PATENT NO. : 4,820,374

DATED : April 11, 1989

INVENTOR(S) : Vernon L. Lamb

It is certified that error appears in the above-identified patent and that said Letters Patent is hereby corrected as shown below:

Column 1, Line 41;
"heated" should be --headed--.

Column 1, Line 58;
"th" should be --the--.

Column 1, Line 59;
"roller" should be --rolled--.

Column 1, Line 66;
"heater" should be --header--.

Column 2, Line 6;
after "drawings" delete "cl".

Column 2, Lines 6 and 7;
heading "BRIEF DESCRIPTION OF THE DRAWINGS"
should be on the same line.

Signed and Sealed this

Tenth Day of April, 1990

*Attest:*

HARRY F. MANBECK, JR.

*Attesting Officer*

*Commissioner of Patents and Trademarks*